US006029075A

United States Patent [19]

Das

[11] Patent Number: 6,029,075

[45] Date of Patent: Feb. 22, 2000

[54] HIGH TC SUPERCONDUCTING FERROELECTRIC VARIABLE TIME DELAY DEVICES OF THE COPLANAR TYPE

[75] Inventor: Satyendranath Das, P.O. Box 574, Mt View, Calif. 94042-0574

[73] Assignees: Manoj K. Bhattacharygia; Satyendranath Das, both of Mt View, Calif.; part interest to each

[21] Appl. No.: 08/840,883

[22] Filed: Apr. 17, 1997

[51] Int. Cl.[7] ..... H01P 1/18; H01B 12/02

[52] U.S. Cl. ..... 505/210; 505/700; 505/701; 505/866; 333/99 S; 333/161

[58] Field of Search ..... 333/99 S, 161; 505/210, 700, 701, 866

[56] References Cited

U.S. PATENT DOCUMENTS

| | | | |
|---|---|---|---|
| 3,670,270 | 6/1972 | Storey, II | 333/161 |
| 4,499,411 | 2/1985 | Lynch et al. | 333/161 |
| 5,164,692 | 11/1992 | Gertel et al. | 333/161 X |
| 5,472,935 | 12/1995 | Yandrofski et al. | 333/161 X |
| 5,521,568 | 5/1996 | Wu et al. | 333/161 X |
| 5,777,532 | 7/1998 | Lakin | 333/161 |

*Primary Examiner*—Benny T. Lee

[57] ABSTRACT

A coplanar waveguide is formed by a spiral with two arms. One arm is labelled 1, and the second arm is labelled 2. The arms labelled 1 and 2 are separated by equal distance. The spiral arms labelled 1 and 2 are formed by the deposition of a film of a conductor, a third layer, on a film 14 of a single crystal ferroelectric material, a second layer, which is deposited on a single crystal dielectric material, a first layer 1. Input is 10 and the output is 11. The CPW spiral arms labelled 1 and 2 forms a time delay device. When a bias voltage V is applied between the two spiral arms labelled 1 and 2 through a bias filter made of an inductor L and a capacitor C, the permittivity of the ferroelectric film between the two spiral arms labelled 1 and 2, or across the CPW, producing a change in the time delay. By the application of different levels of bias voltage between the two spiral arms labelled 1 and 2, different permittivity of the ferroelectric material are obtained and thus different changes in the time delay are obtained. Thus a variable time delay is obtained. Other delay embodiments are (1) meander line, (2) square shaped structure, (3) interdigital line, (4) parallel CPW.

10 Claims, 8 Drawing Sheets

OUTPUT
11
14
2
L
C
TO V
MICROPROCESSOR
20
COMMAND
INPUT
10

FIG.2
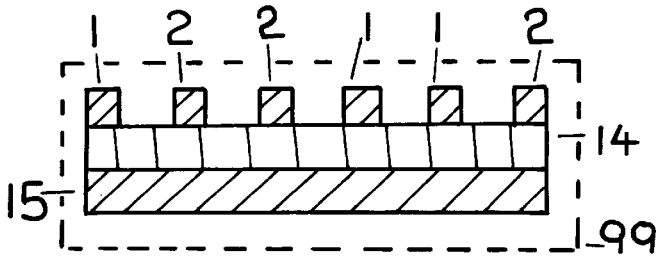
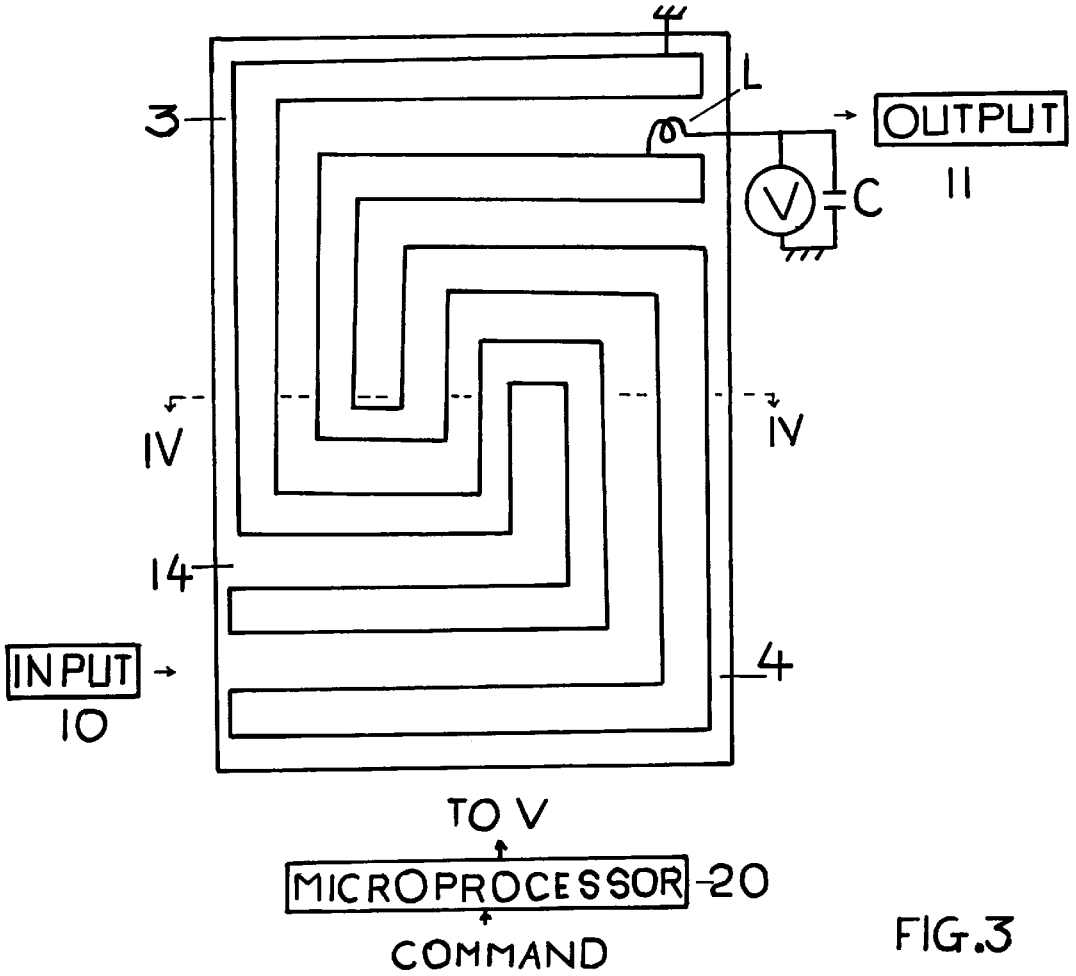
FIG.3

INPUT
10
OUTPUT
11
14
25
24
23
22
26
27
28
29
31
L
C
TO V
MICROPROCESSOR
20
COMMAND
III
III

HIGH TC SUPERCONDUCTING FERROELECTRIC VARIABLE TIME DELAY DEVICES OF THE COPLANAR TYPE

1. FIELD OF INVENTION

The present invention relates to variable time delay devices for electromagnetic waves and more particularly, to RF variable time delay devices which can be controlled electronically. Commercial time delay devices ale available.

2. DESCRIPTION OF THE PRIOR ART

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large. As such the device is small in size. The ferroelectrics are operated in the paraelectric phase, i.e. slightly above the Curie temperature to prevent hysteresis which give a double valued dielectric constant for each value of a biasing field and introduces a hysteresis loss with a.c. biasing field. Inherently, they have a broad bandwidth. They have no low frequency limitation as contrasted to ferrite devices. The high frequency operation is governed by the relaxation frequency, such as 95 GHz for strontium titanate, of the ferroelectric material. The loss of the ferroelectric high Tc superconductor RF variable time delay devices is low for ferroelectric materials, particularly single crystals, with a low loss tangent. A number of ferroelectrics are not subject to burnout. Ferroelectric variable time delay devices are reciprocal. Because the dielectric constant of these devices vary with a bias voltage, the impedance of these devices vary with a biasing electric field.

There are three deficiencies to the current technology : (1) The insertion loss is high as discussed by Das in U.S. Pat. No. 5,451,567. (2) The properties of ferroelectrics are temperature dependent. (3) The third deficiency is the variation of the VSWR over the operating range of the time delay device. Das used a composition of polycrystalline barium titanate, of stated Curie temperature being 20 degrees C and of polythene powder in a cavity and observed a shift in the resonant frequency of the cavity with an applied bias voltage based on the publication by S. Das, "Quality of a Ferroelectric Material," IEEE Trans. MTT-12, pp. 440–448, July 1964.

Das discussed operation, of microwave ferroelectric devices, slightly above the Curie temperature, to avoid hysteresis and showed the permittivity of a ferroelectric material to be maximum at the Curie temperature and the permittivity to reduce in magnitude as one moves away from the Curie temperature based on the publication by S. Das, "Quality of a Ferroelectric Material," IEEE Trans. MTT-12, pp. 440–445, July 1964.

Properties of ferroelectric devices have been discussed in the literature. R. Das, "Ferroelectric Phase Shifters," IEEE Int'l Sympopsium Digest, pp. 185–187, 1987. R. Das, "Thin Ferroelectric Phase Shifters" Solid State Electronics, vol. 10, pp. 857–863, 1967. Ferroelectrics have been used for the time delay steering of an array. S. Das, "Ferroelectrics for time delay steering of an array," Ferroelectrics, 1973, pp. 253–257. Scanning ferroelectric apertures have been discussed. S. Das, "Scanning ferroelectric apertures," The Radio and Electronic Engineer, vol. 44, No. 5, pp. 263–268, May 1974. A high Tc superconducting ferroelectric phase shifter has been discussed. C. M. Jackson, et al, "Novel monolithic phase shifter combining ferroelectric and high temperature superconductors," Microwave and Optical Technology Letters, vol. 5, No. 14, pp. 722–726, Dec. 20, 1992. One U.S. Pat. No. 5,472,936 has been issued.

SUMMARY OF THE INVENTION

A coplanar waveguide is formed by a spiral with two arms. One arm is labelled 1, and the second arm is labelled 2. The arms labelled 1 and 2 are separated by equal distance. The spiral arms labelled 1 and 2 are formed by the deposition of a film of a conductor, a third layer, on a film 14 of a single crystal ferroelectric material, a second layer, which is deposited on a single crystal dielectric material, a first layer. Input is 10 and the output is 11. The coplanar waveguide (CPW) spiral arms labelled 1 and 2 forms a time delay device. When a bias voltage V is applied between the two spiral arms labelled 1 and 2 through a bias filter made of an inductor L and a capacitor C, the permittivity of the ferroelectric film between the two spiral arms labelled 1 and 2, or across the CPW, changes producing a change in the time delay. By the application of different levels of bias voltage between the two spiral arms labelled 1 and 2, different permittivity of the ferroelectric material are obtained and thus different changes in the time delay are obtained. Thus a variable time delay is obtained. Other delay embodiments are (1) meander line, (2) square shaped structure, (3) interdigital line, (4) parallel CPW. One objective of this invention is to obtain a broad bandwidth variable time delay device. Another objective of this invention is to obtain a loss typically of 0.035 dB per wavelength in the ferroelectric material by the use of a single crystal ferroelectric material. Another objective of this invention is to obtain a minimum of conductive loss by the use of a single crystal high Tc superconductor. Another objective of this invention is to obtain a minimum dielectric loss by the use of a single crystal dielectric material. Examples of a single crystal ferroelectric material are $Sr_{1-x}Ba_xTiO_3$, $Sr_{1-x}Pb_xTiO_3$, $KTa_{1-x}Nb_xO_3$ (KTN) where the value of x varies between 0.005 and 0.7 Examples of high Tc super conductors are YBCO and TBCCO. Examples of dielectric material are sapphire and lanthanum aluminate.

The present invention uses low loss ferroelectrics as discussed by Rytz et al. D Rytz, M. B. Klein, B. Bobbs, M. Matloubian and H. Fetterman,"Dielectric Properties of $KTa_{1-x}Nb_xO_3$ at millimeter wavelengths," Japan. J. Appl. Phys. vol. 24 (1985), Supp. 24-2, pp. 1010–1012, and to reduce the conductor losses, uses a high Tc superconductor for the conductor.

This invention uses the variable time delay devices at a constant high Tc superconducting temperature.

The present invention uses a ferroelectric quarter wave matching transformer to obtain a good VSWR over the operating bias electric field range of the variable time delay devices. The bandwidth of the time delay device can be extended by using more than one section quarter wavelength long matching transformers. Deficiencies of CPW of Jackson + U.S. Pat. No. 5,472,936 are listed in the following table:

| ITEM | JACKSON + 5,472,936 | THIS INVENTION |
|---|---|---|
| | STRUCTURAL | |
| KTN | NO | YES |
| SINGLE CRYSTAL FERROELECTRIC | NO | YES |
| SINGLE CRYSTAL DIELECTRIC | NO | YES |
| SINGLE CRYSTAL HIGH Tc SUPERCONDUCTOR | NO | YES |
| QUARTERWAVE TRANSFORMER (MICROSTRIP) | NO | YES |
| COUPLED LINES (MICROSTRIP) | NO | YES |
| | OPERATING | |
| ABOVE CURIE TEMPERATURE | NO | YES |
| HYSTERESIS | YES | NO |
| LOSS | HIGH | 0.035 dB/WAVE-LENGTH |

The measured loss shown in FIG. 4 of Jackson and U.S. Pat. No. 5,472,936 is high.

With these and other objectives in view, as well hereinafter be more particularly pointed out in detail in the appended claims, reference is now made to the following description taken in connection with accompanying diagrams.

BRIEF DESCRIPTION OF THE DRAWINGS

FIG. 2 depicts a longitudinal cross-section of FIG. 1 through section line I—I.

FIG. 3 depicts another embodiment of this invention.

DETAILED DESCRIPTION OF THE PREFERRED EMBODIMENT

Figure 1:
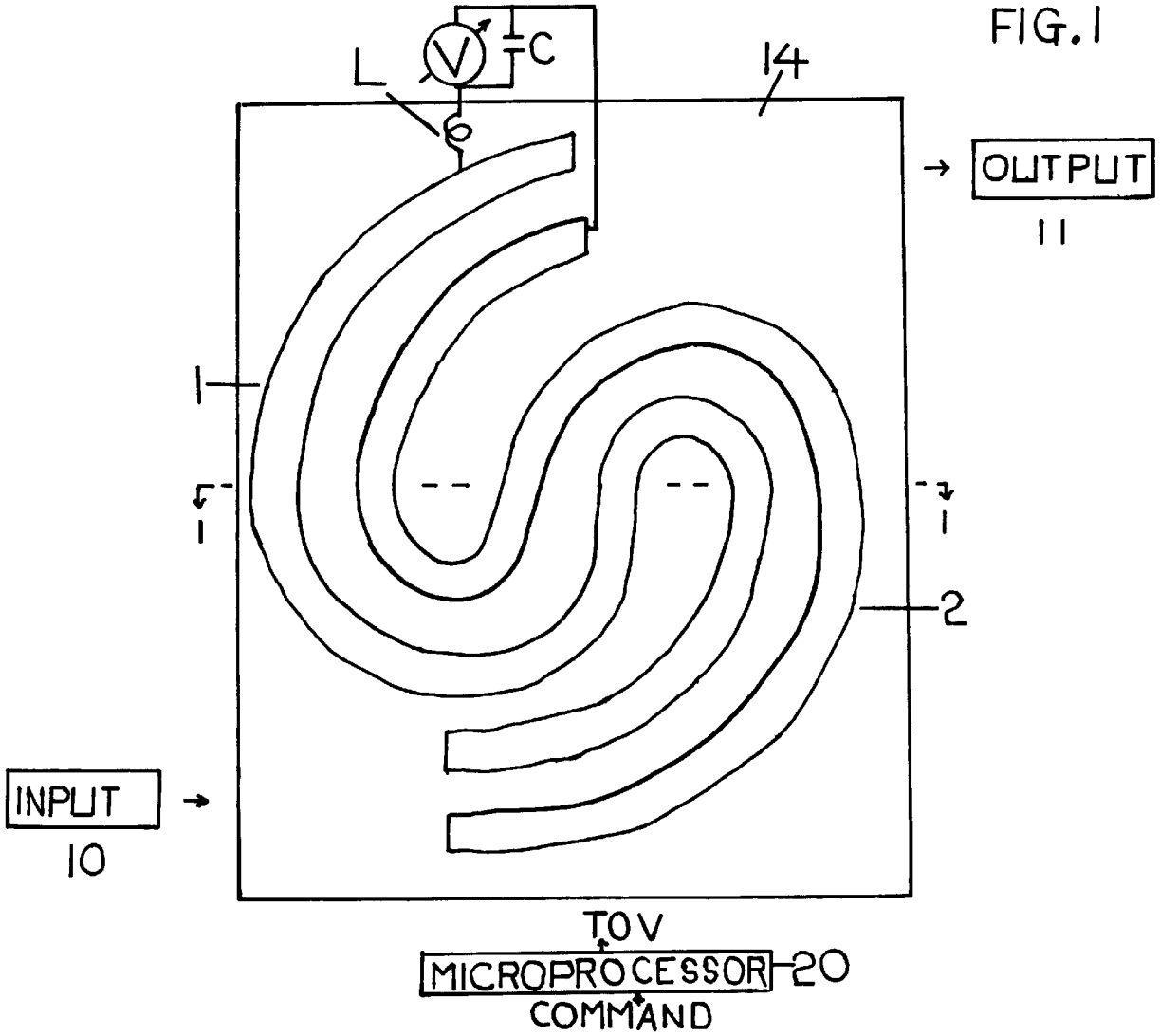
FIG. 1 depicts a top view of an embodiment of this invention.

Same label number refers to the same element throughout this document. FIG. 1 depicts an embodiment of this invention, a coplanar waveguide (CPW) variable time delay device. A coplanar waveguide is formed by a spiral with two arms. One arm is labelled 1, and the second arm is labelled 2. The arms labelled 1 and 2 are separated by equal distance. The spiral arms labelled 1 and 2 are formed by the deposition of a film of a conductor, a third layer, on a film 14 of a single crystal ferroelectric material, a second layer, which is deposited on a single crystal dielectric material, a first layer. Input is 10 and the output is 11. The CPW spiral arms labelled 1 and 2 forms a time delay device. When a bias voltage V is applied between the two spiral arms labelled 1 and 2 through a bias filter made of an inductor L and a capacitor C, the permittivity of the ferroelectric film between the two spiral arms labelled 1 and 2, or across the CPW changes, producing a change in the time delay. By the application of different levels of bias voltage between the two spiral arms labelled 1 and 2, different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied voltage to the time delay device under the control of the microprocessor 20. In one embodiment, the conductor operates generally at the room temperature. Examples are copper, silver, gold. In another embodiment, the conductor is a high Tc superconductor.

The purposes of single crystal materials, in all embodiments of this invention, are discussed here. A single crystal ferroelectric material is used to obtain a dielectric loss, typically, of 0.035 dB per wavelength in the ferroelectric material A single crystal high Tc superconductor is used to obtain a minimum conductive loss. A single crystal dielectric is used to obtain a minimum dielectric loss. A single crystal material is also needed for epitaxial deposition. Examples of a single crystal ferroelectric material are $Sr_{1-x}Ba_xTiO_3$, $Sr_{1-x}Pb_xTiO_3$, $KTa_{1-x}Nb_xO_3$ where the value of x varies between 0.005 and 0.7 Examples of high Tc superocnductors are YBCO and TBCCO. Examples of dielectric material are sapphire and lanthanum aluminate. Compositions of polythene and strontium barium titanate or strontium lead titanate are candidate ferroelectric materials. Ferroelectric liquid crystals (FLC) are also candidate ferroelectric materials.

FIG. 2 is a cross-section of FIG. 1 through section line I—I. The cross-sections of the spiral arms are labelled 1 and 2. A film of a single crystal ferroelectric material is 14, a second layer. A single crystal dielectric material substrate is 15. The variable time delay is operated at a constant temperature slightly above the Curie temperature of the ferroelectric material. When conductors like copper, silver, gold are used, the time delay device is generally kept at the room temperature. The means for keeping at a constant temperature is 99. When a high Tc superconductor material is used, 99 is a cryocooler to keep the time delay device at a constant high superconducting temperature which is currently between 77 and 105 degrees Kelvin.

A small number of turns of the spiral arms labelled 1 and 2 are shown in FIG. 1. Depending on the requirements, the number of turns of the spiral arms is 1, 2 . . . n. Same label number refers to the same element throughout this document.

FIG. 3 depicts an embodiment of this invention, a coplanar waveguide (CPW) variable time delay device. A coplanar waveguide is formed by a square shaped delay device with two arms. One arm is labelled 3, and the second arm is labelled 4. The arms labelled 3 and 4 are separated by equal distance. The square shaped arms labelled 3 and 4 are formed by the deposition of a film of a conductor, a third layer, on a film 14 of a single crystal ferroelectric material, a second layer, which is deposited on a single crystal dielectric material, a first layer. Input is 10 and the output is 11. The CPW square arms labelled 3 and 4 form a time delay device. When a bias voltage V is applied between the two square shaped arms labelled 3 and 4 through a bias filter made of an inductor L and a capacitor C, the permittivity of the ferroelectric film between the two square shaped arms labelled 3 and 4, or across the CPW changes, producing a change in the time delay. By the application of different levels of bias voltage between the two spiral arms labelled 3 and 4, different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied voltage to the time delay device under the control of the microprocessor 20. In one embodiment, the conductor operates generally at the room temperature. Examples are copper, silver, gold. In another embodiment, the conductor is a high Tc superconductor.

FIG. 2 also depicts a transverse cross-section of FIG. 3 through section line IV—IV where 1 represents 3 and 2 represents 4 respectively.

Figure 4:
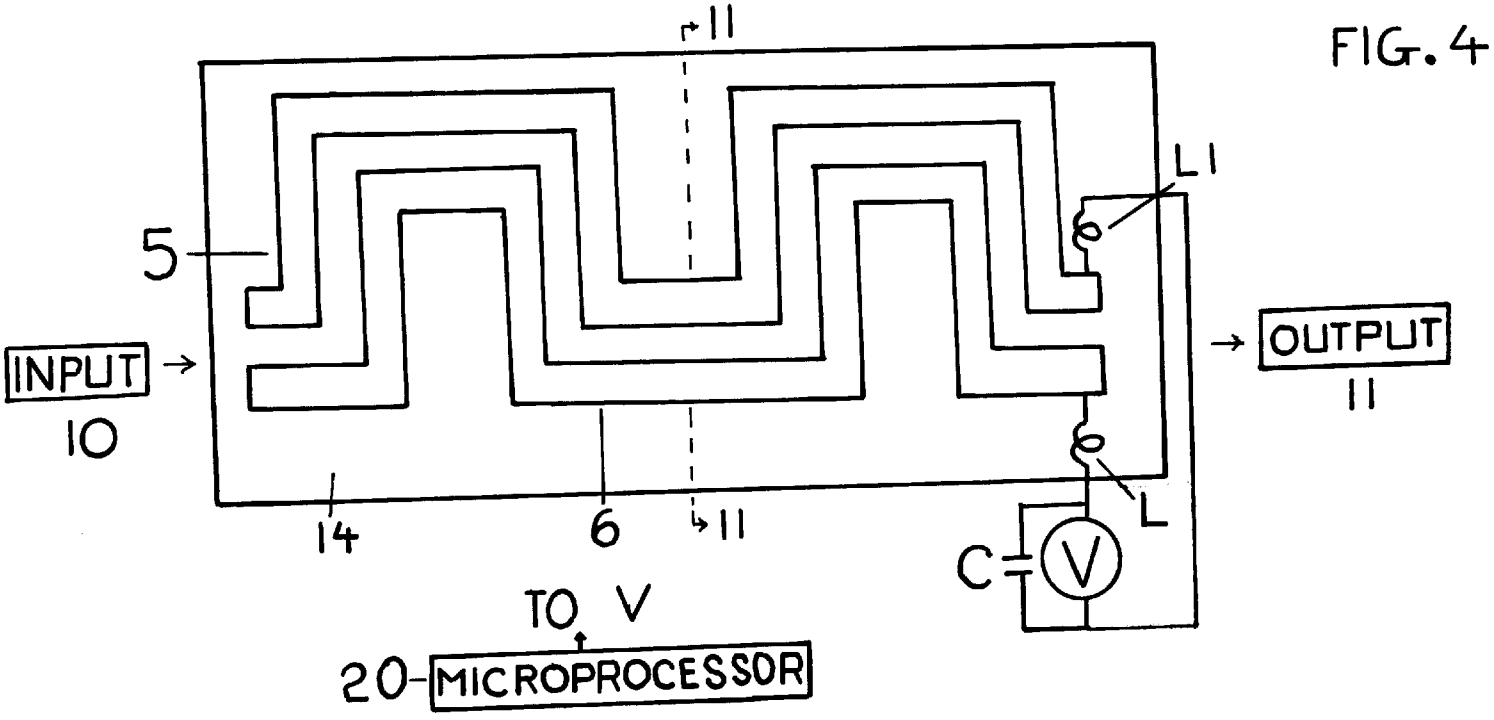
FIG. 4 depicts a top view of another embodiment of this invention.

FIG. 4 depicts an embodiment of this invention, a coplanar waveguide (CPW) variable time delay device. A coplanar waveguide is formed by a meander line with two arms. One arm is labelled 5, and the second arm is labelled 6. The arms labelled 5 and 6 are separated by equal distance. The meander line arms labelled 5 and 6 are formed by the deposition of a film of a conductor, a third layer, on a film 14 of a single crystal ferroelectric material, a second layer, which is deposited on a single crystal dielectric material, a first layer. Input is 10 and the output is 11. The CPW meander line arms labelled 5 and 6 form a time delay device. When a bias voltage V is applied between the two meander line arms labelled 5 and 6 through a bias filter made of an inductor L and a capacitor C, the permittivity of the ferroelectric film between the two meander line arms labelled 5 and 6, or across the CPW changes, producing a change in the time delay. By the application of different levels of bias voltage between the two meander line arms labelled 5 and 6, different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied voltage to the time delay device under the control of the microprocessor 20. In one embodiment, the conductor operates generally at the room temperature. Examples are copper, silver, gold. In another embodiment, the conductor is a high Tc superconductor.

A small number of turns of the meander lines has been shown in FIG. 4. Depending on the requirements, meander lines have 1, 2 . . . n turns.

Figure 5:
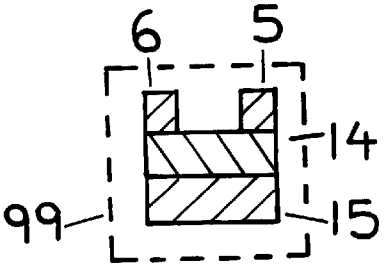
FIG. 5 depicts a transverse cross-section of FIG. 4 through section line II—II.

FIG. 5 is a cross-section of FIG. 4 through section line II—II. The cross-sections of the meander line arms are labelled 5 and 6. A film of a single crystal ferroelectric material is 14, a second layer. A single crystal dielectric material substrate is 15. The variable time delay is operated at a constant temperature slightly above the Curie temperature of the ferroelectric material. When conductors like copper, silver, gold are used, the time delay device is generally kept at the room temperature. The means for keeping at a constant temperature is 99. When a high Tc superconductor material is used, 99 is a cryocooler to keep the time delay device at a constant high superconducting temperature which is currently between 77 and 105 degrees Kelvin. The same label number refers to the same element throughout this document.

Figure 6:
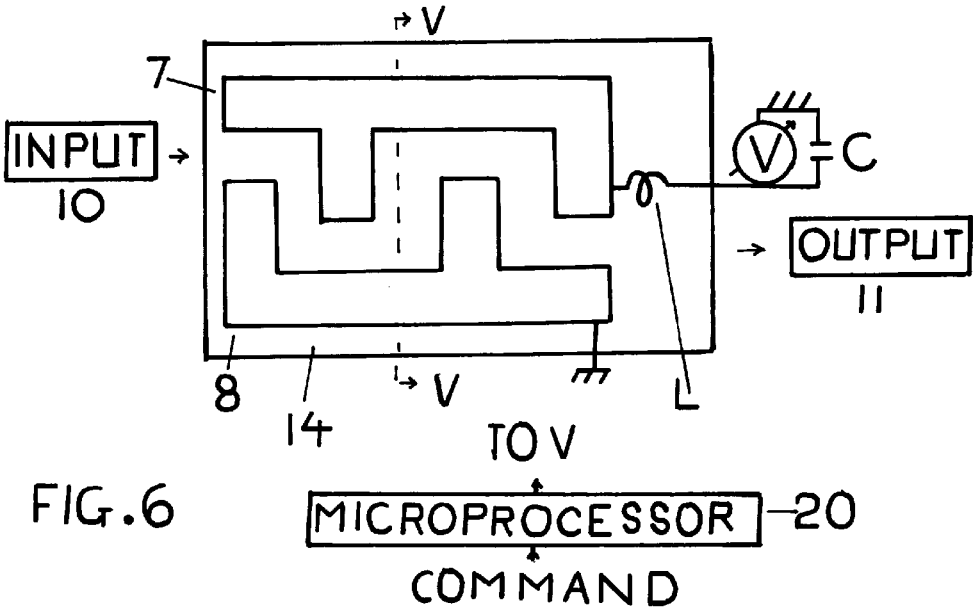
FIG. 6 depicts a top view of another embodiment of this invention.

FIG. 6 depicts an embodiment of this invention, a coplanar waveguide (CPW) variable time delay device. A coplanar waveguide is formed by interdigital lines with two arms. One arm is labelled 7, and the second arm is labelled 8. The arms labelled 7 and 8 are separated by equal distance. The interdigital line arms labelled 7 and 8 are formed by the deposition of a film of a conductor, a third layer, on a film 14 of a single crystal ferroelectric material, a second layer, which is deposited on a single crystal dielectric material, a first layer. Input is 10 and the output is 11. The CPW interdigital line arms labelled 7 and 8 forms a time delay device. When a bias voltage V is applied between the two interdigital line arms labelled 7 and 8 through a bias filter made of an inductor L and a capacitor C, the permittivity of the ferroelectric film between the two interdigital line arms labelled 7 and 8, or across the CPW changes, producing a change in the time delay. By the application of different levels of bias voltage between the two interdigital line arms labelled 7 and 8, different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied voltage to the time delay device under the control of the microprocessor 20. In one embodiment, the conductor operates generally at the room temperature. Examples are copper, silver, gold. In another embodiment, the conductor is a high Tc superconductor. FIG. 5 also represents a transverse cross-section of FIG. 6 through section line V—V where 5 represents 7 and 6 represents 8 respectively. The same label number refers to the same element throughout this document.

A small number of fingers of the interdigital lines has been shown in FIG. 6. Depending on the requirements, interdigital lines have 1, 2 . . . n fingers.

Figure 7:
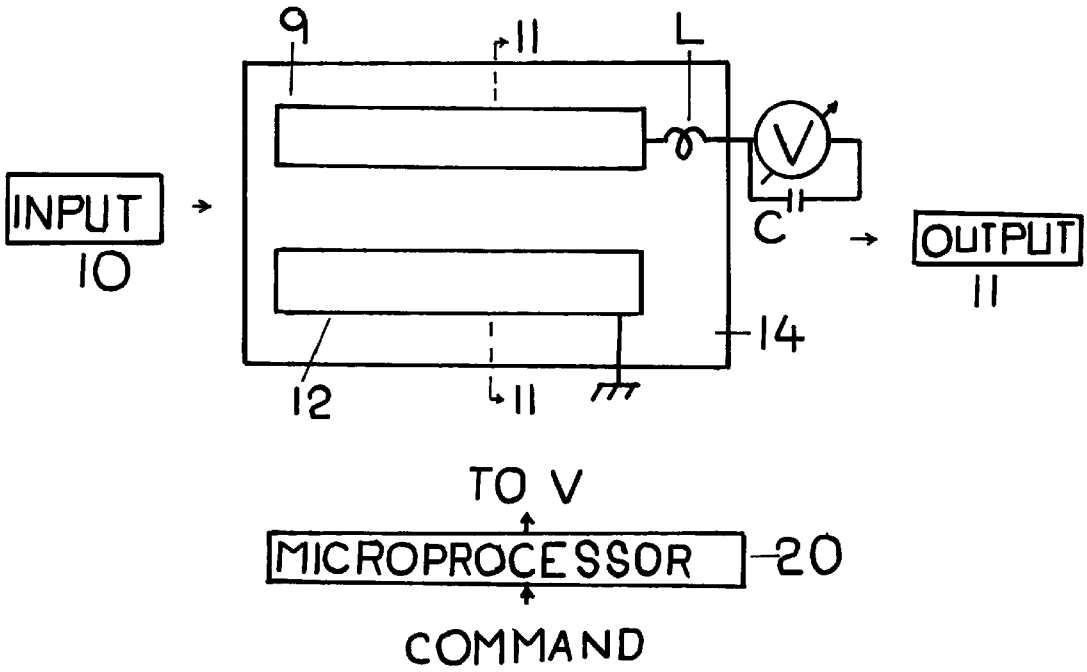
FIG. 7 depicts top view of another embodiment of this invention.

FIG. 7 depicts an embodiment of this invention, a CPW line variable time delay device. A coplanar waveguide is formed by two parallel lines. One line is labelled 9, and the second line is labelled 12. The lines labelled 9 and 12 are separated by equal distance. The parallel CPW lines labelled 9 and 12 are formed by the deposition of a film of a conductor, a third layer, on a film 14 of a single crystal ferroelectric material, a second layer, which is deposited on a single crystal dielectric material, a first layer. Input is 10 and the output is 11. The two parallel CPW lines labelled 9 and 12 form a time delay device. When a bias voltage V is applied between the two parallel lines labelled 9 and 12 through a bias filter made of an inductor L and a capacitor C, the permittivity of the ferroelectric film between the two microstrip lines labelled 9 and 12, or across the CPW changes, producing a change in the time delay. By the application of different levels of bias voltage between the two CPW lines labelled 9 and 12, different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied voltage to the time delay device under the control of the microprocessor 20. In one embodiment, the conductor operates generally at the room temperature. Examples are copper, silver, gold. In another embodiment, the conductor is a high Tc superconductor.

FIG. 5 also represents a transverse cross-section of FIG. 7 through section line II—II where 5 represents 9 and 6 represents 12. Same label number refers to the same element throughout this document.

Figure 8:
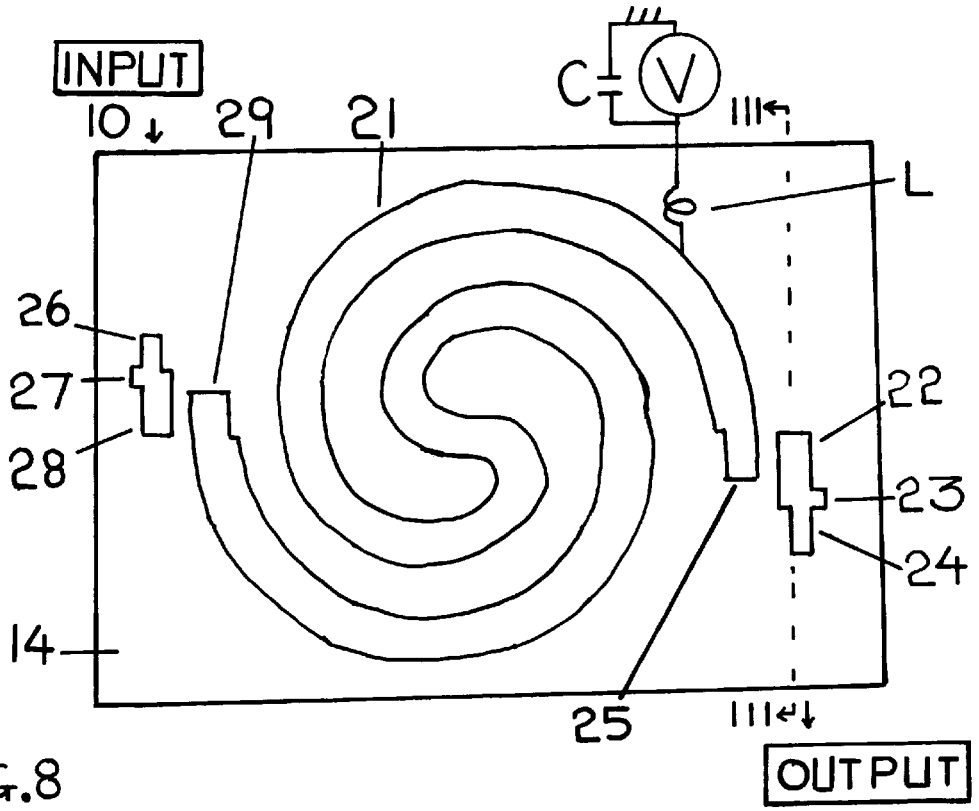
FIG. 8 depicts top view of another embodiment of this invention.

FIG. 8 depicts another embodiment of this invention, a microstrip spiral time delay device. A film 21 of a conductive material is deposited on a film 14 of a single crystal ferroelectric material. In another embodiment, the ferroelectric material is polycrystalline. The film of the ferroelectric material is deposited on a conductive material. A conductive material which generally operates at a room temperature is used. Examples are copper, silver, gold. In another embodiment, a single crystal high Tc superconducting material is used. Examples are YBCO, TBCCO. The spiral microstrip line forms a delay device. On the application of a bias voltage V, through an inductor L and a capacitor C bias filter, to the spiral microstrip line 21, the permittivity of the underlying ferroelectric material 14 changes. This changes the time delay. With an application of different levels of bias voltages to the spiral delay line, different time delays are obtained. Thus a variable time delay is obtained. To isolate the bias voltage from the input and output circuits, quadrature couplers are used at both the input and the output.

A quarter wavelength long, at an operating frequency of the spiral time delay device, microstrip line 25 is connected to the output end of the spiral microstrip line 21. A quarter wavelength long, at an operating frequency of the time delay device, microstrip line 22 is edge coupled to the microstrip line 25. The microstrip line 23, of appropriate length, is used so that the edge coupled time delay device is not affected by the output circuit.

A quarter wavelength long, at an operating frequency of the spiral time delay device, microstrip line 29 is connected to the input end of the spiral microstrip line 21. A quarter wavelength long, at an operating frequency of the time delay device, microstrip line 28 is edge coupled to the microstrip line 29. The microstrip line 27, of appropriate length, is used so that the edge coupled time delay device is not affected by the input circuit.

As the impedance of the ferroelectric time delay device is low, of the order of 2 ohms, a quarter wavelength long, at an operating frequency of the time delay device, is used for matching the time delay to a 50 ohm circuit. A quarter wavelength long, at an operating frequency of the time delay device, microstrip line 26 is used to match the input impedance of the time delay device to an impedance of the input circuit of the time delay device. A quarter wavelength long, at an operating frequency of the time delay device, microstrip line 24 is used for matching the output impedance of the time delay device to an impedance of the output circuit of the time delay device.

A quarter wavelength long transformer provides a reasonable match over a small frequency range. In his 1967 publication, cited above and herein, this inventor obtained a reasonable match, with a single quarter wavelength long section transformer, over a frequency range of 1.33:1 at a center frequency of 3 GHz. A 0.25 wavelength long transformer at 1.5 GHz is 0.016 wavelength long at 0.1 GHz. To obtain a good match over broad frequency range, such as 15:1, a multiple section quarter wavelength long transformers are used.

The time delay values, as a function of the applied bias voltages, are stored in a memory of a microprocessor. On the application of a command for a specific time delay, appropriate bias voltage is set under the control of the microprocessor.

Figure 9:
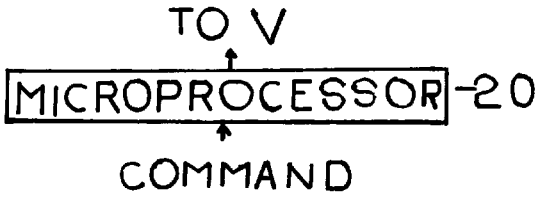
FIG. 9 depicts a longitudinal cross-section through section line III—III of FIG. 8.
Figure 9:
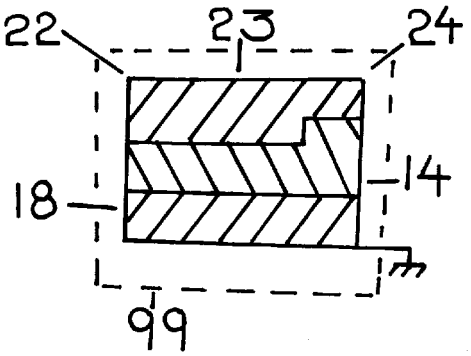

FIG. 9 is a cross-section of FIG. 8 through section line III—III. The quarter wavelength long transformer is 24. A microstrip line, of appropriate length, is 23. A quarter wavelength long, at an operating frequency of the time delay device, microstrip line, for quadrature coupling, is 22. A film of ferroelectric material is 14. The height of the ferroelectric film 14 is larger below the output quarter wavelength, at an operating frequency of the filter, long transformer microstrip line 24 compared to height of the ferroelectric film below the rest of the time delay device. The height of the ferroelctric film 14 is also higher below the input quarter wavelength long transformer (not shown in this diagram) 26 compared to the height of the ferroelectric film below the rest of the time delay device. A conductive material is 18 which is connected to an electrical ground. A means for operating the time delay device at a constant temperature is 99. For conductors, such as copper, silver, gold, the constant temperature is, generally, the room temperature. For a high Tc superconductor material, 99 is a cryocooler and the time delay device is kept at a high superconducting temperature currently between 77 and 105 degrees Kelvin.

Figure 10:
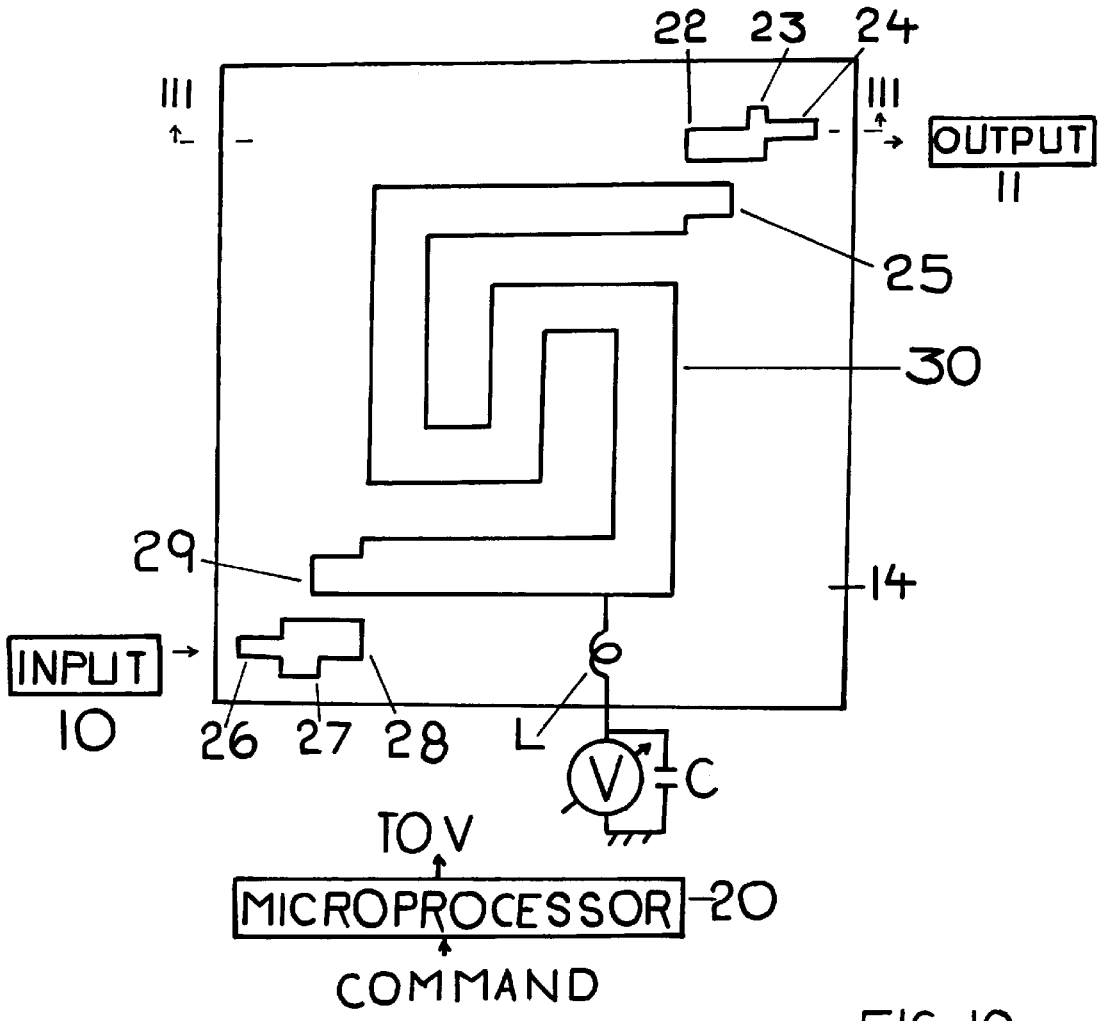
FIG. 10 depicts a top view of another embodiment of this invention.

FIG. 10 depicts another embodiment of this invention, a microstrip square shaped time delay device. A film 30 of a conductive material is deposited on a film 14 of a single crystal ferroelectric material. In another embodiment, the ferroelectric material is polycrystalline. The film of the ferroelectric material is deposited on a conductive material. A conductive material which generally operates at a room temperature is used. Examples are copper, silver, gold. In another embodiment, a single crystal high Tc superconducting material is used. Examples are YBCO, TBCCO. The square microstrip line forms a delay device. On the application of a bias voltage V, through an inductor L and a capacitor C bias filter, to the square shaped microstrip line 30, the permittivity of the underlying ferroelectric material 14 changes. This changes the time delay. With an application of different levels of bias voltages to the square delay line, different time delays are obtained. Thus a variable time delay is obtained. To isolate the bias voltage from the input and output circuits, quadrature couplers are used at both the input and the output.

A quarter wavelength long, at an operating frequency of the square time delay device, microstrip line 25 is connected to the output end of the square microstrip line 21. A quarter wavelength long, at an operating frequency of the time delay device, microstrip line 22 is edge coupled to the microstrip line 25. The microstrip line 23, of appropriate length, is used so that the edge coupled time delay device is not affected by the output circuit.

A quarter wavelength long, at an operating frequency of the square time delay device, microstrip line 29 is connected to the input end of the square microstrip line 30. A quarter wavelength long, at an operating frequency of the time delay device, microstrip line 28 is edge coupled to the microstrip line 29. The microstrip line 27, of appropriate length, is used so that the edge coupled time delay device is not affected by the input circuit.

As the impedance of the ferroelectric time delay device is low, of the order of 2 ohms, a quarter wavelength long, at an operating frequency of the time delay device, is used for matching the time delay to a 50 ohm circuit. A quarter wavelength long, at an operating frequency of the time delay device, microstrip line 26 is used to match the input impedance of the time delay device to an impedance of the input circuit of the time delay device. A quarter wavelength long, at an operating frequency of the time delay device, microstrip line 24 is used for matching the output impedance of the time delay device to an impedance of the output circuit of the time delay device.

A quarter wavelength long transformer provides a reasonable match over a small frequency range. In his 1967 publication, cited above and herein, this inventor obtained a reasonable match, with a single quarter wavelength long section transformer, over a frequency range of 1.33:1 at a center frequency of 3 GHz. A 0.25 wavelength long transformer at 1.5 GHz is 0.016 wavelength long at 0.1 GHz. To obtain a good match over broad frequency range, such as 15:1, a multiple section quarter wavelength long transformers are used.

The time delay values, as a function of the applied bias voltages, are stored in a memory of a microprocessor. On the application of a command for a specific time delay, appropriate bias voltage is set under the control of the microprocessor.

FIG. 9 is a cross-section also of FIG. 10 through section line III—III. Numeral 22 represents 24 and 24 represents 22. Same label number refers to the same element throughout this document.

Figure 11:
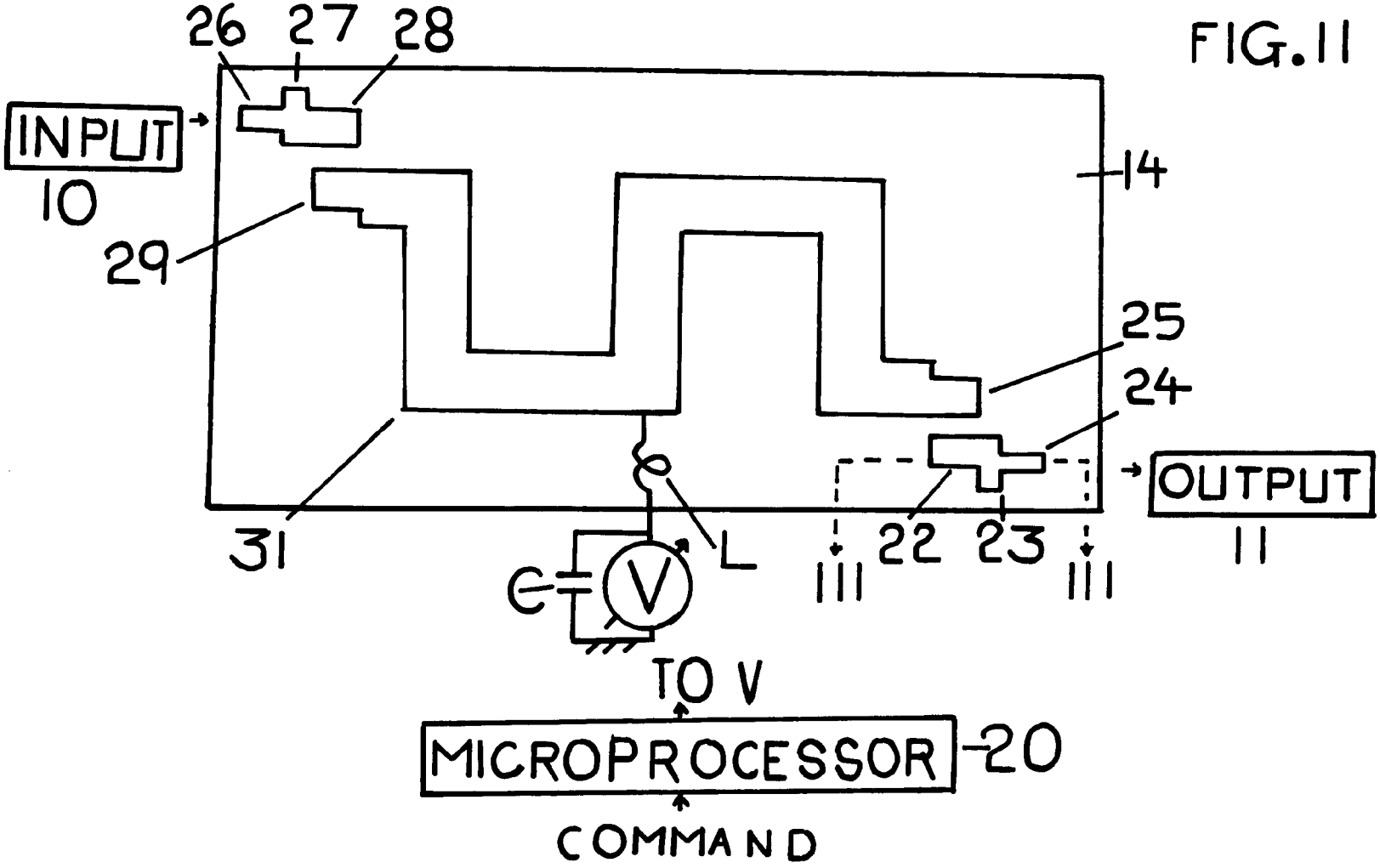
FIG. 11 depicts a top view of another embodiment of this invention.

FIG. 11 depicts another embodiment of this invention, a microstrip meander line time delay device. A film 31 of a conductive material is deposited on a film 14 of a single crystal ferroelectric material. In another embodiment, the ferroelectric material is polycrystalline. The film of the ferroelectric material is deposited on a conductive material. A conductive material which generally operates at a room temperature is used. Examples are copper, silver, gold. In another embodiment, a single crystal high Tc superconducting material is used. Examples are YBCO, TBCCO. The meander line microstrip line forms a delay device. On the application of a bias voltage V, through an inductor L and a capacitor C bias filter, to the meander line 31, the permittivity of the underlying ferroelectric material 14 changes. This changes the time delay. With an application of different levels of bias voltages to the spiral delay line, different time delays are obtained. Thus a variable time delay is obtained. To isolate the bias voltage from the input and output circuits, quadrature couplers are used at both the input and the output.

A quarter wavelength long, at an operating frequency of the meander line time delay device, microstrip line 25 is connected to the output end of the meander line microstrip line 31. A quarter wavelength long, at an operating frequency of the time delay device, microstrip line 22 is edge coupled to the microstrip line 25. The microstrip line 23, of appropriate length, is used so that the edge coupled time delay device is not affected by the output circuit.

A quarter wavelength long, at an operating frequency of the meander line time delay device, microstrip line 29 is connected to the input end of the meander line microstrip line 31. A quarter wavelength long, at an operating frequency of the time delay device, microstrip line 28 is edge coupled to the microstrip line 29. The microstrip line 27, of appropriate length, is used so that the edge coupled time delay device is not affected by the input circuit.

As the impedance of the ferroelectric time delay device is low, of the order of 2 ohms, a quarter wavelength long, at an operating frequency of the time delay device, is used for matching the time delay to a 50 ohm circuit. A quarter wavelength long, at an operating frequency of the time delay device, microstrip line 26 is used to match the input impedance of the time delay device to an impedance of the input circuit of the time delay device. A quarter wavelength long, at an operating frequency of the time delay device, microstrip line 24 is used for matching the output impedance of the time delay device to an impedance of the output circuit of the time delay device.

A quarter wavelength long transformer provides a reasonable match over a small frequency range. In his 1967 publication, cited above and herein, this inventor obtained a reasonable match, with a single quarter wavelength long section transformer, over a frequency range of 1.33:1 at a center frequency of 3 GHz. A 0.25 wavelength long transformer at 1.5 GHz is 0.016 wavelength long at 0.1 GHz. To obtain a good match over broad frequency range, such as 15:1, a multiple section quarter wavelength long transformers are used.

The time delay values, as a function of the applied bias voltages, are stored in a memory of a microprocessor. On the application of a command for a specific time delay, appropriate bias voltage is set under the control of the microprocessor.

FIG. 9 is a cross-section of FIG. 11 through section line III—III. Same label number refers to the same element throughout this document.

Figure 12:
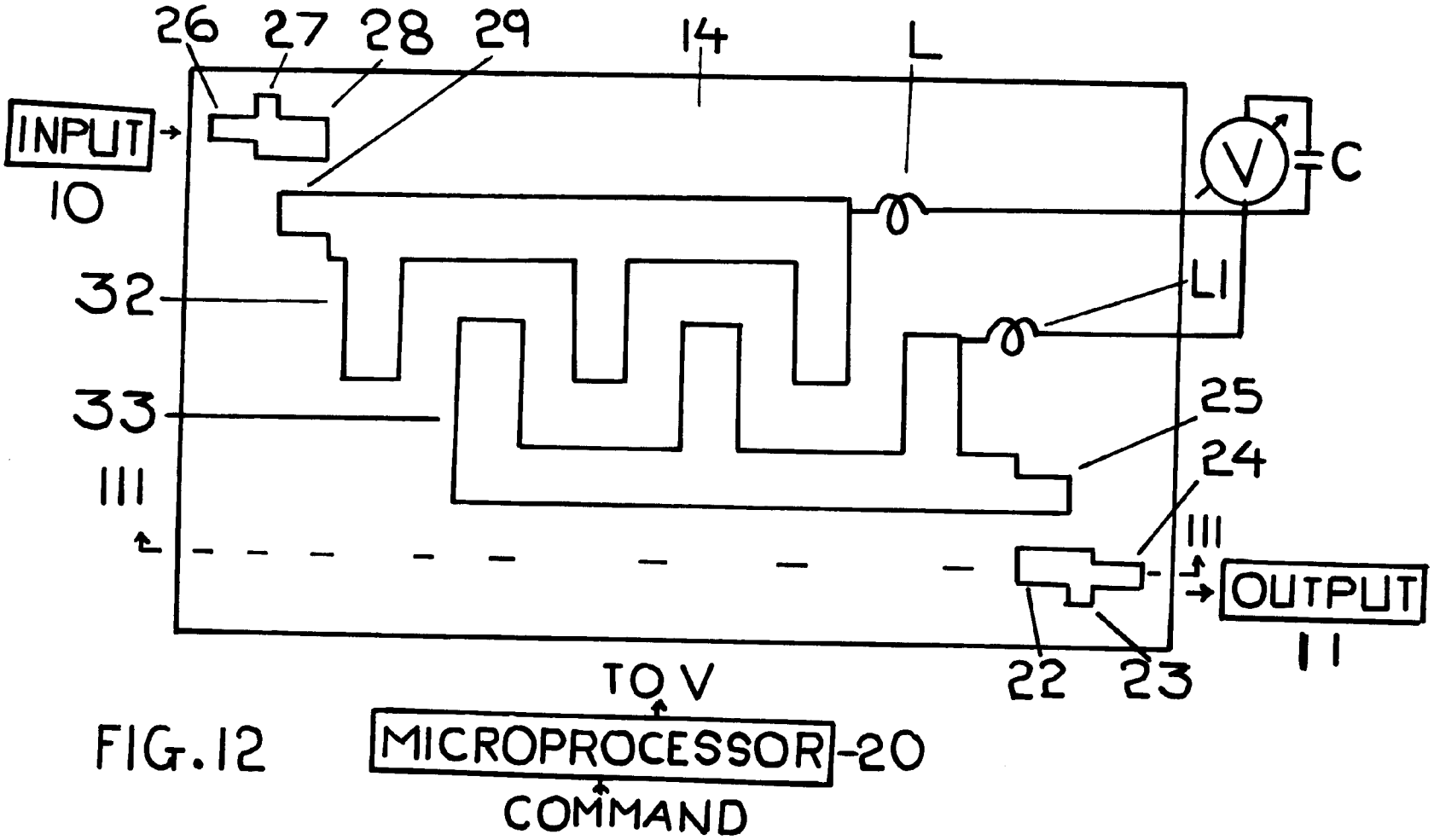
FIG. 12 depicts a top view of another embodiment of this invention.

FIG. 12 depicts another embodiment of this invention, a microstrip interdigital line time delay device. Films 32 and 33 of a conductive material is deposited on a film 14 of a single crystal ferroelectric material. In another embodiment, the ferroelectric material is polycrystalline. The film of the ferroelectric material is deposited on a conductive material. A conductive material which generally operates at a room temperature is used. Examples are copper, silver, gold. In another embodiment, a single crystal high Tc superconducting material is used. Examples are YBCO, TBCCO. The interdigital line microstrip line forms a delay device. On the application of a bias voltage V, through an inductor L and a capacitor C bias filter, to the interdigital lines 32 and 33, the permittivity of the underlying ferroelectric material 14 changes. This changes the time delay. With an application of different levels of bias voltages to the delay line, different time delays are obtained. Thus a variable time delay is obtained. To isolate the bias voltage from the input and output circuits, quadrature couplers are used at both the input and the output.

A quarter wavelength long, at an operating frequency of the interdigital line time delay device, microstrip line 25 is connected to the output end of the interdigital line microstrip line 33. A quarter wavelength long, at an operating frequency of the time delay device, microstrip line 22 is edge coupled to the microstrip line 25. The microstrip line 23, of appropriate length, is used so that the edge coupled time delay device is not affected by the output circuit.

A quarter wavelength long, at an operating frequency of the interdigital line time delay device, microstrip line 29 is connected to the input end of the interdigital line microstrip line 32. A quarter wavelength long, at an operating frequency of the time delay device, microstrip line 28 is edge coupled to the microstrip line 29. The microstrip line 27, of appropriate length, is used so that the edge coupled time delay device is not affected by the input circuit.

As the impedance of the ferroelectric time delay device is low, of the order of 2 ohms, a quarter wavelength long, at an operating frequency of the time delay device, is used for matching the time delay to a 50 ohm circuit. A quarter wavelength long, at an operating frequency of the time delay device, microstrip line 26 is used to match the input impedance of the time delay device to an impedance of the input circuit of the time delay device. A quarter wavelength long, at an operating frequency of the time delay device, microstrip line 24 is used for matching the output impedance of the time delay device to an impedance of the output circuit of the time delay device.

A quarter wavelength long transformer provides a reasonable match over a small frequency range. In his 1967 publication, cited above and herein, this inventor obtained a reasonable match, with a single quarter wavellenght long section transformer, over a frequency range of 1.33:1 at a center frequency of 3 GHz. A 0.25 wavelength long transformer at 1.5 GHz is 0.016 wavelength long at 0.1 GHz. To obtain a good match over broad frequency range, such as 15:1, a multiple section quarter wavelength long transformers are used.

The time delay values, as a function of the applied bias voltages, are stored in a memory of a microprocessor. On the application of a command for a specific time delay, appropriate bias voltage is set under the control of the microprocessor 20.

FIG. 9 is a cross-section of FIG. 12 through section line III—III. The same label number refers to the same element throughout this document.

Each embodiment of the time delay device has 1, 2 . . . n turns. Other embodiments have polycrystalline ferroelectric materials. Other embodiments have conductive materials which can, generally, work at room temperatures. Examples are copper, silver, gold. Other embodiments have a high Tc superconductor material.

It should be understood that the foregoing disclosure relates to only typical embodiments of the invention and that numerous modification or alternatives may be made therein by those of ordinary skill in art without departing from the spirit and the scope of the invention as set forth in the appended claims. Specifically, the invention contemplates various CPW dielectrics including sapphire, lanthanum aluminate, ferroelectrics, ferroelectric liquid crystals (FLCs), high Tc superconducting materials including YBCO, TBCCO, impedances, MMICs, tunable filter configurations, layers of time delay devices, operating bias voltage of the time delay devices, number of resonators and frequencies.

What is claimed is:

1. A ferroelectric variable time delay device having a ferroelectric material having an electric field dependent permittivity, a Curie temperature, an input, an output, operating frequency and comprising:

first, second and third layers;

said first layer comprised of a single crystal dielectric substrate;

said second layer comprised of a KTN film of said single crystal ferroelectric material having said permittivity deposited on the single crystal dielectric material of said first layer;

said third layer comprised of a film of a single crystal high Tc superconducting material deposited on the film of said single crystal ferroelectric material of said second layer;

said third layer being a spiral shaped coplanar waveguide having two arms;

separation distance between said two arms of said spiral being constant;

said two arm spiral shaped coplanar waveguide having 1, 2 . . . n turns;

means for applying a bias voltage to said time delay device;

a microprocessor for controlling said bias voltage, for a specific value of time delay, on command; and means attached to said time delay device, for operating the time delay device at a high superconducting temperature.

2. A ferroelectric variable time delay device of claim 1:

wherein the single crystal high Tc superconducting material is YBCO.

3. A ferroelectric variable time delay device of claim 1:

wherein the single crystal high Tc superconducting material being YBCO and the single crystal dielectric substrate being sapphire.

4. A ferroelectric variable time delay device of claim 1:

wherein the single crystal high Tc superconducting material being TBCCO.

5. A ferroelectric variable time delay device having a ferroelectric material having an electric field dependent permittivity, a Curie temperature, an input, an output, operating frequency and comprising:

first, second and third layers;

said first layer comprised of a single crystal dielectric substrate;

said second layer comprised of a film of said single crystal ferroelectric material having said permittivity deposited on the single crystal dielectric material of said first layer;

said single crystal ferroelectric material being $Sr_{1-x}Pb_xTiO_3$ and the value of x being between 0.005 and 0.7;

said third layer comprised of a film of a single crystal high Tc superconducting material deposited on the film of said single crystal ferroelectric material of said second layer;

said third layer being a spiral shaped coplanar waveguide (CPW) having two arms;

separation distance between said two arms of said spiral being constant;

said two arm spiral shaped coplanar waveguide having 1, 2, . . . n turns;

means for applying a bias voltage to said two arms of said CPW time delay device;

a microprocessor for controlling said bias voltage, for a specific value of time delay, on command; and means attached to said time delay device, for operating the time delay device at a high superconducting temperature.

6. A ferroelectric variable time delay device having a ferroelectric material having an electric field dependent permittivity, a Curie temperature, an input, an output, operating frequency and comprising:

said first, second, and third layers;

said first layer comprised of a single crystal dielectric substrate;

said second layer comprised of a film of a single crystal ferroelectric material deposited on the single crystal dielectric material of first layer;

said ferroelectric material being $Sr_{1-x}Pb_xTiO_3$ where the value of x being between 0.005 and 0.7;

said third layer comprised of a film of a single crystal high Tc superconducting material deposited on the film of said single crystal ferroelectric material of second layer;

said third layer being an interdigital shaped coplanar waveguide (CPW) having two arms;

separation distance between said two arms of said interdigital shaped CPW being constant;

said two arm interdigital shaped coplanar waveguide having 1, 2 . . . n fingers;

means for applying a bias voltage to said two arms of said CPW delay device;

a microprocessor for controlling said bias voltage, for a specific value of time delay, on command; and means attached to said time delay device for operating the time delay device at a high Tc superconducting temperature.

7. A ferroelectric variable time delay device of claim 6:

wherein the single crystal high Tc superconducting material is YBCO.

8. A ferroelectric variable time delay device of claim 6:

wherein the single crystal dielectric being sapphire and the high Tc superconducting material being TBCCO.

9. A ferroelectric variable time delay device of claim 6:

wherein the single crystal high Tc superconducting material being TBCCO.

10. A ferroelectric variable time delay device of claim 6:

wherein the single crystal high Tc superconducting material being YBCO and the single crystal dielectric being sapphire.

* * * * *